US005615596A

United States Patent [19]

Issa

[11] Patent Number: 5,615,596

[45] Date of Patent: Apr. 1, 1997

[54] INFLATED BALL CONTAINER REPRESSURIZER

[75] Inventor: Antoine Issa, Vancouver, Canada

[73] Assignee: Innovatec Products International, Inc., Vancouver, Canada

[21] Appl. No.: 564,906

[22] Filed: Nov. 29, 1995

[51] Int. Cl.[6] ..... F01B 19/00

[52] U.S. Cl. ..... 92/98 R; 220/212; 206/315.9

[58] Field of Search ..... 92/98 R, 98 D; 220/203.4, 203.7, 203.19, 212; 206/315.9

[56] References Cited

U.S. PATENT DOCUMENTS 3,415,357 12/1968 Van Natter ..... 206/315.9
3,581,881 6/1971 Hobbs, II ..... 206/315.9
3,853,222 12/1974 Helms ..... 206/315.9
3,888,347 6/1975 Kramer .
4,019,629 4/1977 Dubner et al. .
4,020,948 5/1977 Won .
4,124,117 11/1978 Rudy .
4,428,478 1/1984 Hoffman ..... 206/315.9
5,311,988 5/1994 Bronson .

*Primary Examiner*—Thomas E. Denion
*Attorney, Agent, or Firm*—Anderson, Levine & Lintel, L.L.P.

[57] ABSTRACT

A device for repressurizing an inflated ball container which includes a diaphragm dimensioned to fit snugly into an end of said container, a core slidably positioned inside the diaphragm and an actuator movable so as to cause the core to engage an interior surface of the diaphragm and seal it against an interior surface of the container. Upon pressing in on the diaphragm, air is forced into the container.

17 Claims, 6 Drawing Sheets

OPEN

CLOSED

INFLATED BALL CONTAINER REPRESSURIZER

FIELD

The present invention relates to a device for applying and maintaining pressure inside a container for an inflated ball such as a tennis ball container filled with tennis balls.

BACKGROUND

Inflated balls such as tennis balls and squash balls are hollow with an interior that is filled with gas under pressure to provide proper resiliency and bounce. However, over time such balls leak and lose their pressure as the gas leaks through the porous membrane of the ball, eventually rendering the ball unacceptable for use. It is known that by maintaining tennis balls in a pressurized can such balls can be kept pressurized indefinitely. Pumps have been developed for use with tennis ball containers but most have been difficult to operate and many have been too complex to be practical.

U.S. Pat. No. 3,888,347 issued to Kramer discloses a hand operated pump attached to the side wall of the container in which the outlet of the pump communicates through a hole in the sidewall of the container. A hand operated piston type pump requires a user to move the piston up and down in close proximity to the sidewall of the can, making it somewhat difficult and awkward to move. Moreover, a custom can is required to accommodate the pump.

U.S. Pat. No. 4,019,629 issued to Dubner et al. discloses a piston-type pump having a housing which fits over the outside end of the can. Not only is it difficult to hold the housing onto the can while lifting the piston, the low compressive strength of the can makes the can susceptible to damage and leakage.

U.S. Pat. No. 4,020,948 issued to Won discloses a replacement container rather than a pump adapted to be affixed to a standard container. Won shows two telescoping tubes with sliding seals between the two. Such a design would be expensive to fabricate and, considering the large area requiring sealing, there would be considerable likelihood of leakage.

U.S. Pat. No. 4,124,117 issued to Rudy discloses utilizing a chemical within the container and a suitable fluid that reacts with the chemical to generate a gas at atmospheric pressure to elevate the pressure within the ball. Each time the container is reused a new charge of chemical and liquid is necessary. The need to recharge the chemical is inconvenient as it must usually be done at the place where a supply of the chemical is available.

U.S. Pat. No. 5,311,988 issued to Bronson discloses a sleeve dimensioned to receive an open end of a standard container and which seals against a lip of the container. As the sleeve is pushed against the container it compresses the gas within and pressurizes the container. Development of pressure depends upon sealing all around the perimeter of the container open end. However, the end of the container is often flexible and relatively fragile. Thus, such a sleeve may not work on plastic containers or even metal ones having thin aluminum walls.

Accordingly, it is an object of the invention to provide an improved device for repressurizing a tennis ball container. It is a further object to provide a pump which can be easily attached and removed from an open end of a tennis ball container without damaging the end of the container. It is yet a further object of the invention to provide a repressurizing pump whose operation does not depend upon the number of balls in the container.

SUMMARY OF THE INVENTION

According to the invention there is provided a device for repressurizing an inflated ball container which includes a diaphragm dimensioned to fit snugly into an end of said container, a core slidably positioned inside the diaphragm and an actuator movable so as to cause the core to engage an interior surface of the diaphragm and seal it against an interior surface of the container. Upon pressing in on the diaphragm, air is forced into the container.

Preferably a check valve is located in the core and the diaphragm has an air vent over which a user's hand is placed during pumping. The diaphragm may have a depending skirt with a ring around an exterior thereof and diametrically opposed cylindrical openings therein. A lever with opposed cylindrical bosses and an off center pin projecting out from a flat face of each boss may be slidably inserted into a mating opening in the core so that upon pivoting of the lever, the core may move relative to the diaphragm from a position away from the diaphragm to a position engaged with a skirt of the diaphragm.

A pin may be insertable through the ring and affixed to a pressure release valve passing from an interior of the core therethrough and abutting a stem of the pin so that upon pushing in the pin the pressure release valve opens and permits atmospheric air to enter into an interior of the core.

The pin, when in a released position, fits over the lever when the lever is in a position so as to engage the core and diaphragm to lock the lever in place and, when pushed in, permits the lever to be pivoted to a position in which the core is disengaged from the diaphragm.

In another aspect of the invention there is provided a repressurizing device for a tennis ball container which includes a rigid core dimensioned to fit through an open end of a tennis ball container, a resilient dome-shaped diaphragm having an air hole in a top thereof and a skirt dimensioned to slide over the core, a rigid ring which encloses a circumferential core contacting region of said diaphragm, and an actuator coupled to the core and the diaphragm and operative to raise and lower said core relative to the diaphragm and upon being raised seals a lower open end of the diaphragm against the inside wall of the container relative to the core and seals the inside part of the dome against the core. A check valve permits gas to pass from the volume under the dome shaped diaphragm into the container but not in the reverse direction. A few compressions of the diaphragm causes the pressure inside the container to increase by as much as 14 psi.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
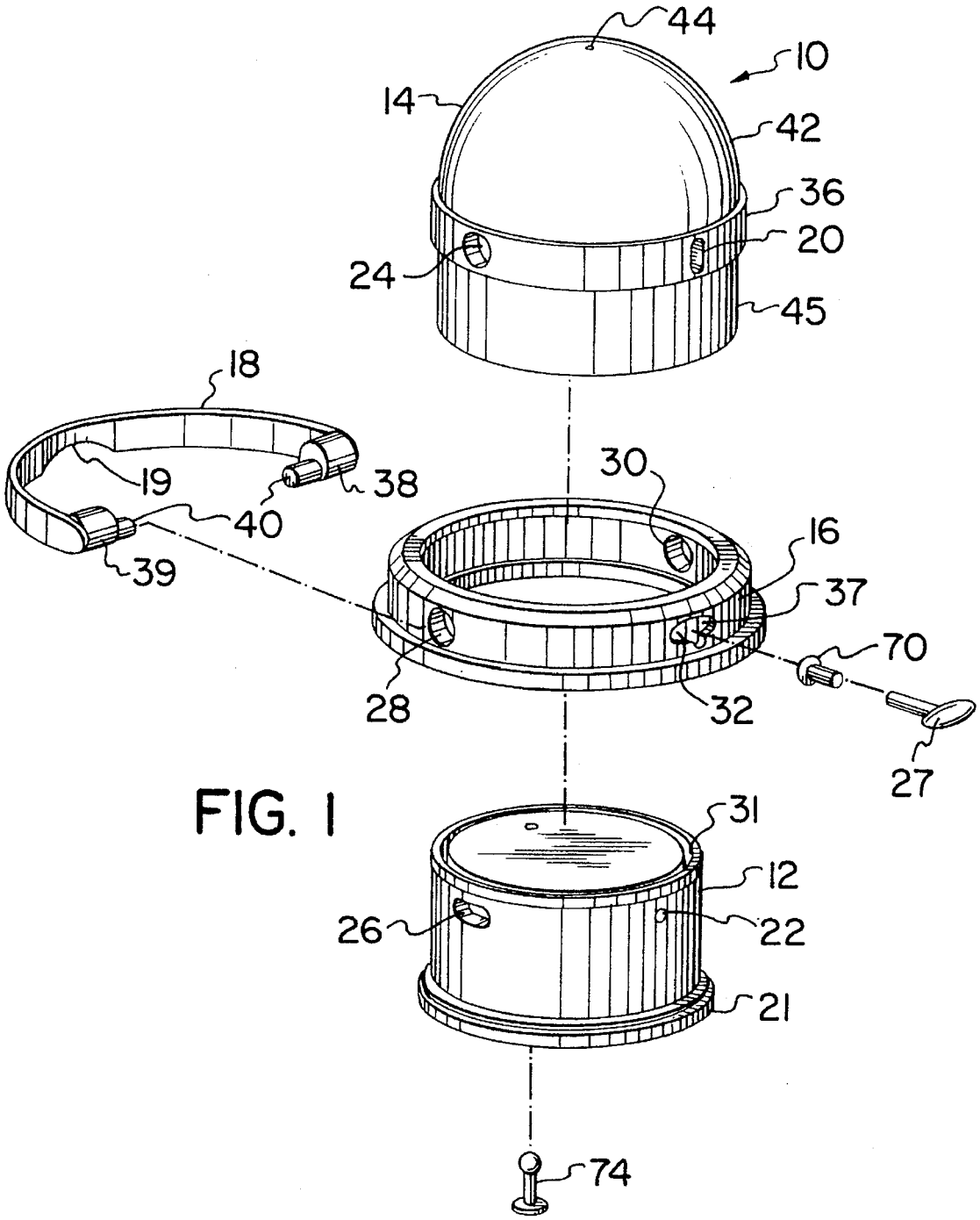
FIG. 1 is a perspective exploded view of the device.

Referring to FIG. 1, the container repressurizer 10 consists of four principal parts, namely, a core 12 made of lightweight plastic, a diaphragm 14 made of flexible silicone rubber, a rigid ring 16 which fits around a thickened band 36 of the diaphragm 14 and a rigid lever 18 made of polycarbonate. A lever lock 27 is insertable into holes 32 and 20 of ring 16 and diaphragm 14, respectively, in alignment with hole 22 in the core 12. A recess 37 in ring 16 is formed around hole 32. Lever 18 has a pair of rounded discs 38 which slidably engage holes 28 in ring 16 and holes 24 in thickened band 36. Pins 40 pass through holes 28 and 24 into slot 26. The width of slot 26 equals the diameter of pin 40. The bottom of core 12 has a outwardly and downwardly projecting region 21. A circumferential groove 31 is formed in the top of core 12 near the outer periphery thereof.

Figure 2:
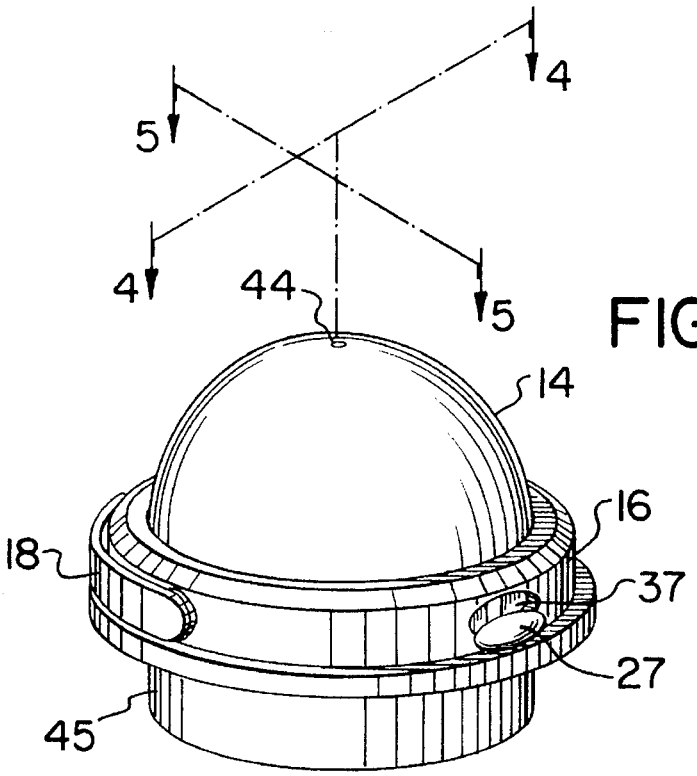
FIG. 2 is a perspective view of the device in the open position in which it can be inserted and removed from an end of a tennis can container.

Referring to FIG. 2, lever 18 is positioned so that pins 40 shown in FIG. 1 are in a lowermost position and, therefore, core 12 is moved away from diaphragm 14 leaving skirt 45 to hang without deflection. Lever locking pin 27 and valve 70 is positioned to lie on the bottom of holes 32 and 20.

Figure 3:
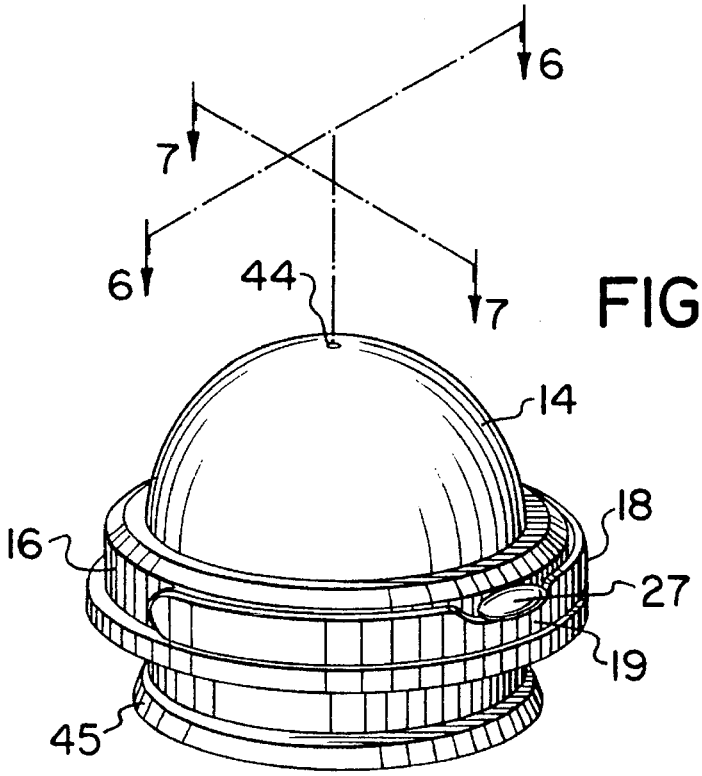
FIG. 3 is a perspective view of the device in the closed position in which it is sealed to an end of a tennis can container.

Referring to FIG. 3, the lever 18 is positioned so that pins 40 (see FIG. 1) are in a uppermost position and, therefore, core 12 is in a position closest to diaphragm 14. A recess 19 in lever 18 engages locking pin 27 so that lever 18 cannot be accidentally moved. The region 21 of core 12 presses against the bottom of skirt 45 and moves it outwardly.

Figure 4:
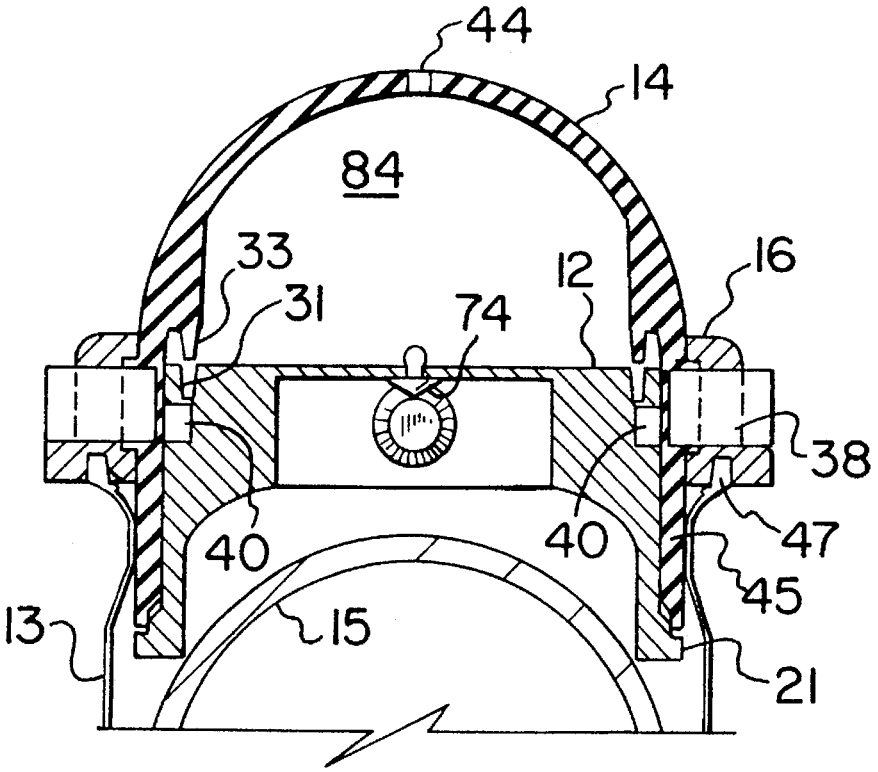
FIG. 4 is a cross sectional view in elevation of the device in an open position taken along the line AA of FIG. 2.
Figure 6:
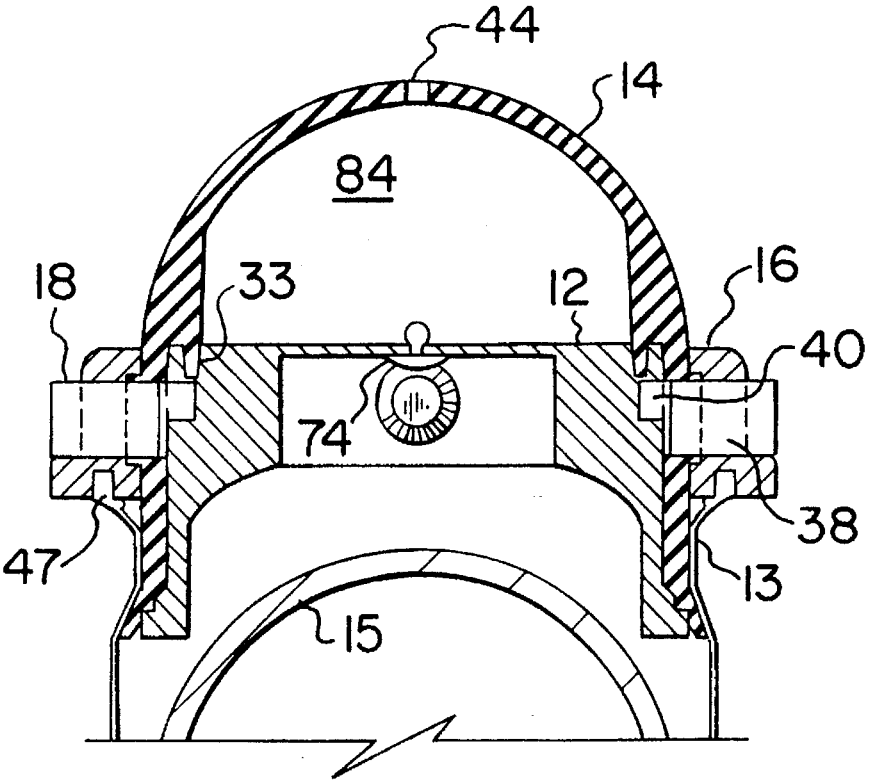
FIG. 6 is a cross sectional view in elevation of the device in a closed position taken along the line CC of FIG. 3.

Referring to FIG. 4, the device 10 is positioned over an open end of container 13 and pushed in until a rim at the open end of container 13 is received by a groove 47 at a bottom of ring 16. A check valve 74 is located in a wall of core 12 that separates an area under diaphragm 14 from an interior of core 12. Initially region 21 is below skirt 45 with tongue 33 spaced away from groove 31. The two pins 40 are in the lowermost position with respect to discs 38 so that core 12 is positioned below a bottom of skirt 45. Region 21 moves past and does not press against the bottom of skirt 45 as device 10 is being inserted into container 13. The interior of diaphragm 14 has a downwardly projecting tongue 33 which removably inserts into groove 31 on the top surface of the core 12 as the core moves from an open position as in FIG. 4 to a closed position as shown in FIG. 6. The tongue 33 when inserted into groove 31 provides a seal of chamber 85 against leakage around the perimeter of diaphragm 14.

Figure 5:
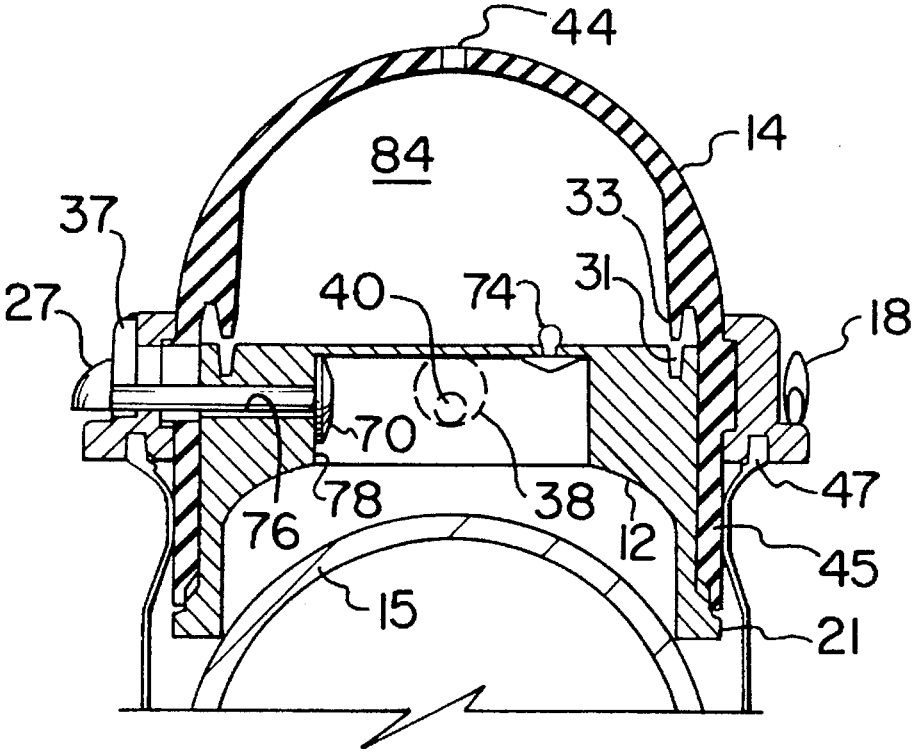
FIG. 5 is a cross sectional view in elevation of the device in an open position taken along the line BB of FIG. 2.

Referring to FIG. 5, in which the core is in the open position, a release valve 70 is positioned in a bore 76 in core 12 and is in tension so that it is biased against face 78. Locking pin 27 attaches to release valve 70 so that manual pressure on pin 27 causes the head of pin 27 to enter recess 37 and to open release valve 70 and expose an interior of core 12 to atmosphere. In this open position, region 21 is below skirt 45 which can freely slide through an open end of container 13.

Figure 7:
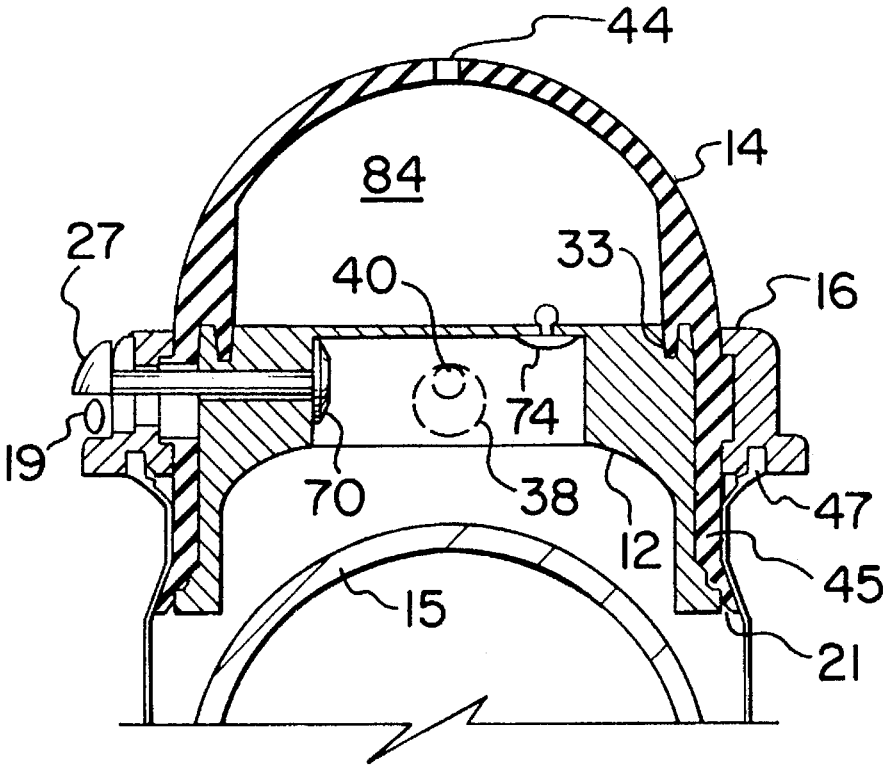
FIG. 7 is a cross sectional view in elevation of the device in a closed position taken along the line DD of FIG. 3.

Referring to FIGS. 6 and 7, the core 12 is in the closed position, with tongue 33 inserted into groove 31 and lever 18 positioned so that recess 19 is underneath locking pin 27, thereby preventing lever 18 from pivoting upwardly. In this position region 21 of core 12 is abutting a bottom of skirt 45 and pressing it against an inside wall of container 13 thereby sealing the interior of container 13 from atmosphere.

With the device 10 in the position shown by FIGS. 6 and 7, a user simply places a hand over hole 44 and compresses diaphragm 14. Compression of diaphragm 14 causes check valve 74 to open and allow the air to flow from region 84 into an interior of core 12. Release of diaphragm 14 causes valve 74 to close and air to enter through opening 44. The compression is repeated until the interior of container 13 reaches a maximum pressure after which container 13 is simply stored for later use with device 10 left in place. Once it is desired to use the balls in the container 13 again, locking pin 27 is first depressed to open valve 70 and release the pressure from the interior of container 13. Pressing in pin 27 further allows lever 19 to pivot over pin 27 to the other side as shown in FIG. 2, thereby moving core 12 down and releasing the seal of skirt 45 against the wall of container 13. The device 10 is then simply removed to provide access to the interior of container 13.

Figure 8:
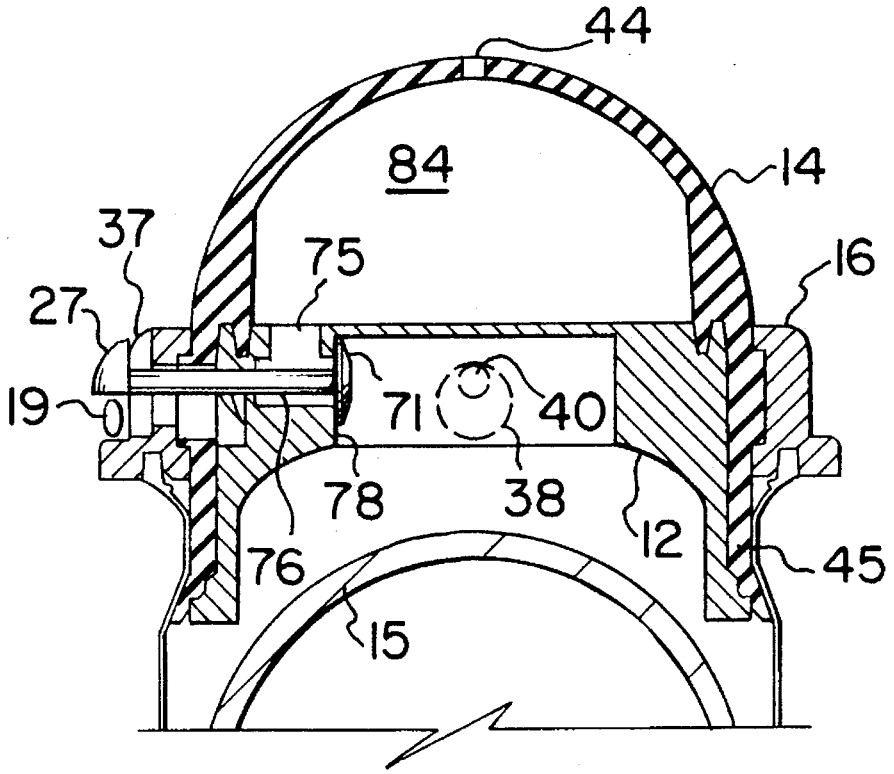
FIG. 8 is a cross sectional view of an alternative embodiment of the invention with the pump sealed against an end of a tennis ball container.
Figure 9:
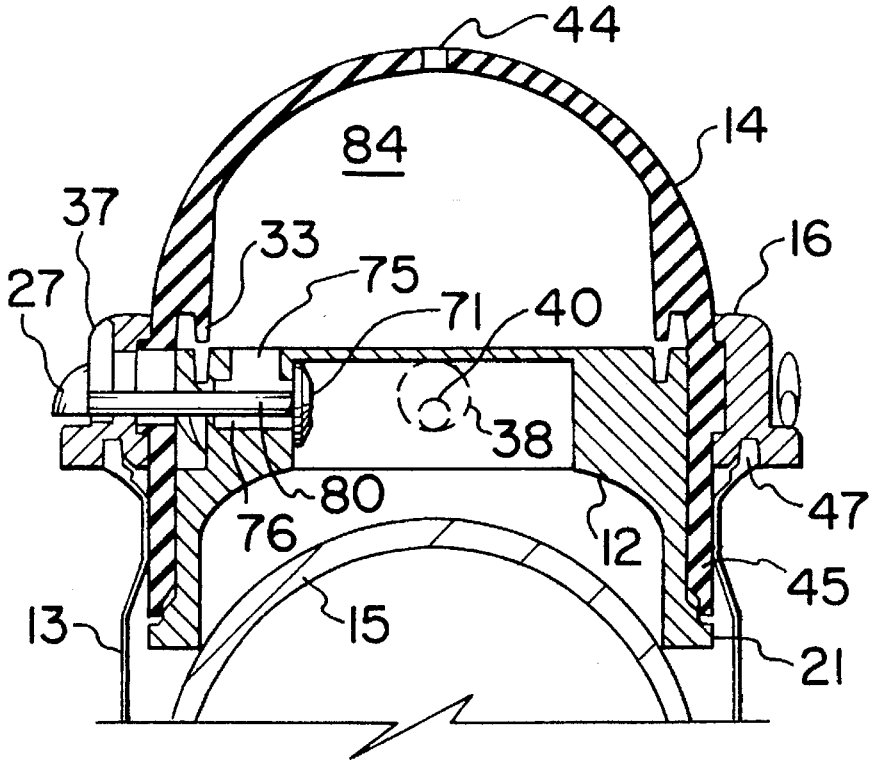
FIG. 9 is a cross sectional view in elevation of the configuration of FIG. 8 except with the pump unsealed.

An alternative design shown in FIGS. 8 and 9 consists of eliminating check valve 74 and combining both a release valve and check valve function into valve 71. In this case a bore 75 places chamber 84 into fluid communication with bore 76. Pin 27 is coupled to a stem of valve 71 and a slight tension is created between the two parts so that valve 71 is biased against face 78 to seal an interior of core 12. User applied pressure on pin 27 causes valve 71 to open and permit air to enter past bore 76 and valve 71 into an interior of core 12.

Figure 10:
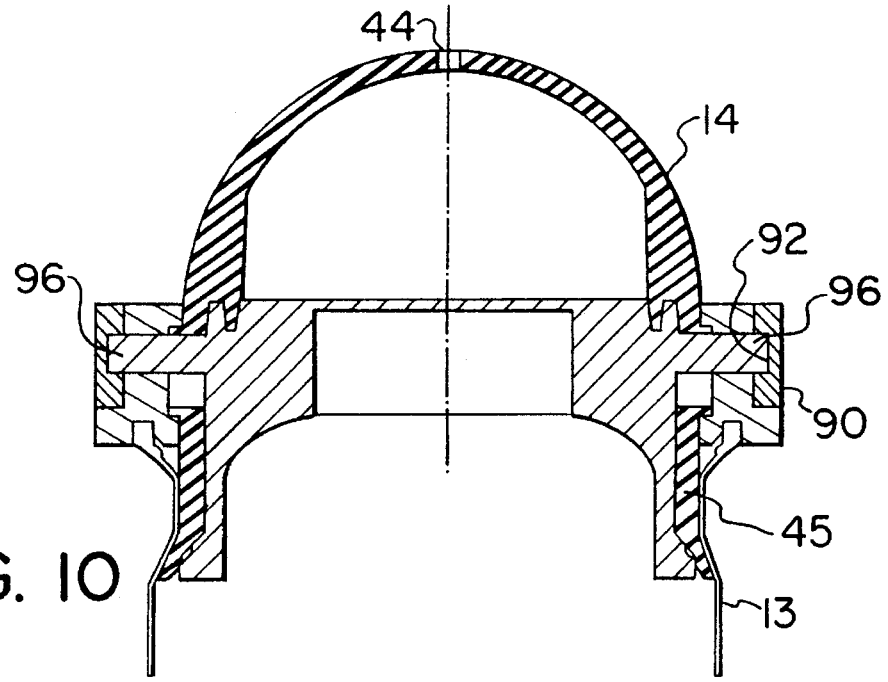
FIG. 10 is a cross-sectional view in elevation of an alternative embodiment using a spiral groove in the interior of the ring to raise and lower the core.
Figure 11:
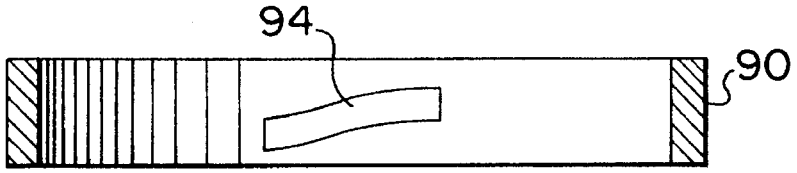
FIG. 11 shows the spiral core and one of the two grooves.
Figure 12:
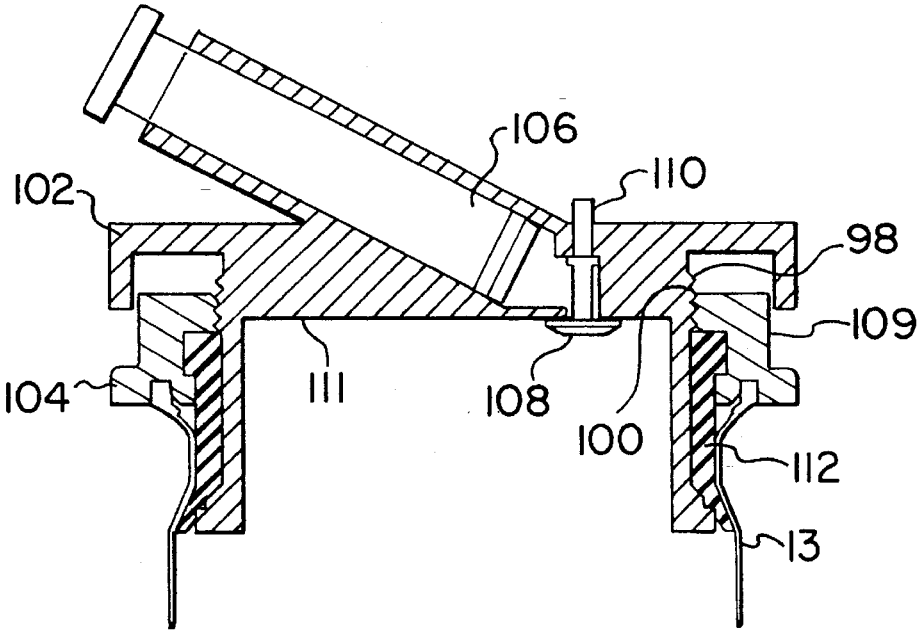
FIG. 12 is yet another alternative embodiment which uses a double action piston pump.

Another alternative design shown in FIGS. 10 and 11 consists of replacing the lever 18 with a rotatable ring 90 having helical grooves 94 on the inside of ring 90 which engage pins 96 on both sides and upon rotation of ring 90 cause pins 96 to move up or down, depending upon the direction of rotation.

Yet another alternative is shown in FIG. 10 in which the diaphragm 14 is replaced by a double action piston pump 106 and the lever 18 by screw threads 98 on core 102 which register with threads 100 on ring 109. Resilient skirt 112 is captured between ring 109 and core 102. A valve 108 seats against an interior face 111 of core 102 against which it is biased. A release rod 110 abuts an end of valve 108 and, in response to being pressed, opens valve 108 to release the pressure inside container 13. Withdrawing and inserting the piston of pump 106 causes valve 108 to open and air compressed by the piston to enter container 13. Skirt 112 is sealed against the inside of container 13 by rotating core 102 so that it withdraws from ring 109.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A device for repressurizing a inflated ball container, comprising:

(a) a diaphragm dimensioned to fit snugly into an end of said container;

(b) a core slidably positioned inside said diaphragm; and (c) an actuator movable so as to cause said core to engage an interior surface of said diaphragm and seal it against an interior surface of said container, wherein upon pressing in on said diaphragm, air is forced into said container.

2. A device according to claim 1, including a check valve in said core and wherein said diaphragm has an air vent over which a user's hand is placed during pumping.

3. A device according to claim 1, wherein said diaphragm has a depending skirt and a ring around an exterior thereof with cylindrical openings therein and including a lever with cylindrical boss and an off center pin projecting out from a flat face thereof and slidably inserted into a mating opening in said core so that upon pivoting of said lever, said core moves relative to said diaphragm from a position away from said diaphragm to a position engaged with a skirt of said diaphragm.

4. A device according to claim 3, including a pin insertable through said ring and affixed to a pressure release valve passing from an interior of said core therethrough and abutting a stem of said pin so that upon pushing in said pin said pressure release valve opens and permits atmospheric air to enter into an interior of said core.

5. A device according to claim 4, wherein said pin when in a released position fits over said lever when said lever is in a position so as to engage said core and diaphragm to lock said lever in place and, when pushed in, permits said lever to be pivoted to a position in which said core is disengaged from said diaphragm.

6. A device for repressurizing a tennis ball container, comprising:

(a) a core having a depending core sleeve insertable into an interior of said container through an open end thereof;

(b) a resilient skirt slidable over an outside of said core sleeve between said core sleeve and an open end of the container;

(c) a ring enclosing said core and having a rim receptacle dimensioned to receive a rim of said container;

(d) means for releasing pressure in an interior of said core when sealed to said container;

(e) a pump coupled to said ring and said core, said pump operative to compress air;

(f) a check valve in said core operative in response to pressure applied by said pump to open and allow the compressed air to pass through said core into an interior thereof; and (g) means for moving said core relative to said ring from an open position wherein said skirt is adjacent an end wall of said container to a closed position in which said core seals said skirt against the end wall of said container.

7. A device according to claim 6, wherein said pump is a diaphragm pump.

8. A device according to claim 6, wherein said means for moving includes a pair of cams mounted in said ring and engaging said core so that upon rotation of said cams said core moves relative to said ring.

9. A device according to claim 8, including a lever coupled to said cams operative to pivot and rotate said cams.

10. A device according to claim 7, wherein said diaphragm pump has a resilient dome with an opening therein.

11. A device according to claim 6, wherein said means for releasing includes a release valve passing through said core, said pump and said ring and operative in response to user applied pressure to admit atmospheric air into an interior of said container.

12. A device according to claim 7, including a tongue on one of said core and said diaphragm and a groove on the other of said core and said diaphragm positioned so as to receive said tongue and form a air tight tongue and groove seal upon said diaphragm moving towards said core.

13. A repressurizing device for a tennis ball container having a rigid core dimensioned to fit through an open end of the tennis ball container, a resilient dome-shaped diaphragm having an air hole in a top thereof and a skirt dimensioned to slide over the core, a rigid ring which encloses a circumferential core contacting region of said diaphragm, and an actuator mounted in said ring and coupled to said core and operative to raise and lower said core relative to said diaphragm, and, upon said core being raised, seals a lower open end of the skirt of said diaphragm against the inside wall of the container relative to the core, a check valve slidably mounted in said core and operative to permit air to pass from within said diaphragm to an interior of said container and means for releasing pressure from and interior of said container.

14. A pump according to claim 13, wherein said core has an outwardly and downwardly directed cylindrical region at a bottom of said skirt which contacts and seals said diaphragm against an inside wall of said container as said core is raised.

15. A pump according to claim 13, wherein said actuator is cam mounted in said ring and engaging said core and a lever coupled to said cam, operative to rotate said cam in response to pivoting of said lever.

16. A pump according to claim 15, including a lock passing through said ring and operative to block said lever from pivotal motion.

17. A pump according to claim 13, wherein said means for releasing pressure is a release valve mounted in said core and operative in response to user applied pressure to admit outside air into an interior of said container.

* * * * *